United States Patent [19]

Fischer

[11] 4,192,282

[45] Mar. 11, 1980

[54] TILE CUTTER

[76] Inventor: John P. Fischer, 1064 Goffle Rd., Hawthorne, N.J. 07506

[21] Appl. No.: 921,536

[22] Filed: Jul. 3, 1978

Related U.S. Application Data

[63] Continuation-in-part of Ser. No. 815,471, Jul. 14, 1977, abandoned.

[51] Int. Cl.[2] ..... B28P 1/32

[52] U.S. Cl. ..... 125/23 T

[58] Field of Search ..... 125/23 R, 23 T; 225/96.5

[56] References Cited

U.S. PATENT DOCUMENTS

| | | | |
|---|---|---|---|
| 1,873,721 | 8/1932 | Postley | 125/23 R |
| 1,995,741 | 3/1935 | Granite | 125/23 T |
| 2,289,985 | 7/1942 | Nastri | 125/23 R |
| 2,568,816 | 9/1951 | Marus | 125/23 T |
| 3,889,862 | 6/1975 | Iusolio | 225/96.5 |
| 4,026,262 | 5/1977 | Yasuga | 125/23 T |

*Primary Examiner*—Harold D. Whitehead

*Attorney, Agent, or Firm*—James J. Cannon, Jr.; James J. Cannon

[57] ABSTRACT

A unified tile scoring and fracturing device having a simple adjustment for making straight or diagonal cuts on a piece of tile. The tile cutter provides a guide rod above and parallel to the base of the tile cutter and a single control handle having widely disposed lateral fins. A rotatable tile scoring wheel is provided at the forward base of the control handle to score the tile. The handle is movably and slidably fitted along the guide rod. Tile cutting is effected by sliding the handle along the guide rod while exerting downward pressure to cause the scoring disk to score the tile, thereby making a cut line. After the tile is scored, further downward pressure is exerted on the handle to cause the lateral fins to fracture the tile along the scored line. A simple novel means is provided to position the tile on the tile cutter accurately for both straight and diagonal cuts.

1 Claim, 3 Drawing Figures

FIG. 1
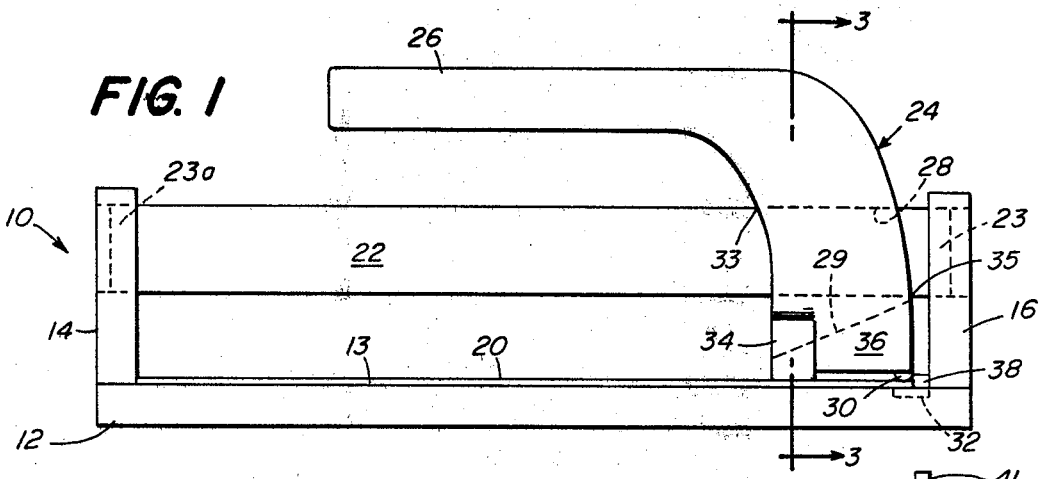
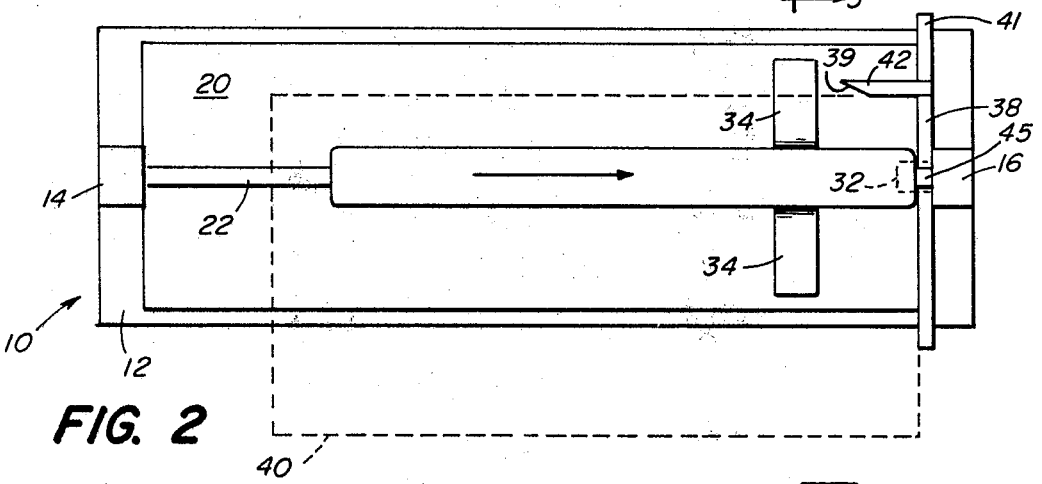
FIG. 2
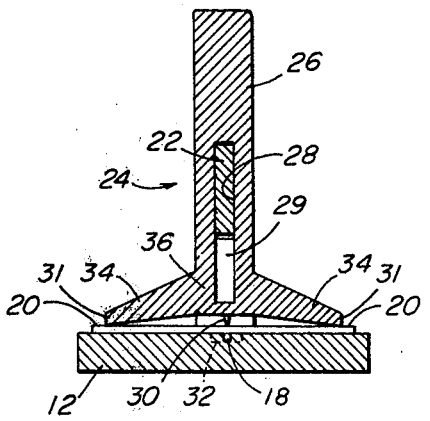
FIG. 3

TILE CUTTER

This application is a continuation-in-part of my prior application Ser. No. 815,471, filed July 14, 1977 and now abandoned.

BACKGROUND OF THE INVENTION

1. Field of the Invention

The present invention relates to improvements in tile cutters generally and namely to devices for scoring and fracturing tile, glass and the like ceramic or vitreous plate-like materials. More particularly it relates to an improved and simplified device for scoring and fracturing ceramic tile and includes a novel means to position the tile for precise cuts, both perpendicular to and diagonally to the referenced edge.

2. Description of the Prior Art

The literature is replete with descriptions of numerous prior art devices which have been designed to accomplish the dual task of both scoring or incising and subsequently fracturing a ceramic tile, plate of glass or a like vitreous material. Most of the prior art devices have suffered from minor drawbacks which have not proved critical until recently. Recent developments which have led to the development of improved tile cutters are the increasing hardness of ceramic tiles as ceramic technology improves; the increasing thickness of ceramic tiles in use today for decorative effects; and the pressure for greater productivity of the tile installer because of rising labor costs.

Until recently, the only commercially available and widely used tile cutters were one sold under the tradename Simplex and disclosed in U.S. Pat. No. 1,873,721 and others issued to Postley; and one sold under the tradename Tilex and disclosed in U.S. Pat. No. 2,246,351 and others issued to Engleke. Both of these tile cutters suffered from the fact that the tile was placed in one position for scoring or incising and then placed in another position for fracturing. While not necessarily a difficult operation, this extra motion was ineffecient in its consumption of time. It also required extra manipulation of the component assemblies of the tile cutters. A second consideration leading to the development of new tile cutters is that neither of these commercially available tile cutters performs well with the very thick tiles which are now both available and extremely popular in the consumer market.

Recently, an improved tile cutter, made under U.S. Pat. No. 4,026,262, issued to Yasuga, has become commercially available. This tile cutter is very similar to that of the present invention, but also differs from the present invention in critical respects. Both the Yasuga device and the device of the present application are attempts to improve and simplify the Tilex device and both use variations of the Simplex handle. Both devices use a guide rod positioned above and parallel to the cutter base. Both use a curved handle bearing a cutting wheel or disk which scores a tile when pressure is applied to the handle and the handle is pushed along the guide rod under pressure. These features are old and are disclosed in the Postley and Engleke patents. Both the Yasuga device and the device of the present invention improve upon the prior art in the neither device requires repositioning of the tile in order to fracture the tile along the scored line. Each of these devices accomplishes this goal by incorporating a pair of lateral fins at the base of the curved handle some distance behind the scoring desk. After the tile is scored, additional downward pressure is exerted upon the handle, causing the fins to engage the tile and forcing a fracture along the scored line. The combined handle, scoring desk and fin structure of the Yasuga device and the device of the present invention are different. The Yasuga handle incorporates and claims a complex cam means for adjustment of the height of the scoring desk for varying thicknesses of tile. This requires additional time and work for the laborer and serves no useful purpose. With applicant's device, which has a simple, fixed position cutting disk, the user simply raises or lowers the handle to accomodate tiles of varying thickness. The height adjustment means for the scoring desk as implemented and claimed in the Yasuga device are simply unnecessary complexities which have no effect on the functional performance of the device. Applicant's handle means is simpler in structure, has fewer parts, is less expensive to manufacture, is simpler to use and is at least equally effective. It should be pointed out here that the Yasuga device has been commercially available for about one year at the time of this writing while applicant's device has just finished its prototype development. For reasons which are not at all obvious and in fact are unknown to the trade, the Yasuga device does not function well in the cutting of thick, hard tiles. For this reason and for another reason, discussed hereinafter, the Yasuga device has been a commercial failure in the trade.

The Yasuga device uses and claims an adjustable sliding plate means mounted within the handle to facilitate the sliding movement of the handle along the guide rod. This is not only unnecessary; it also adds to the cost and complexity of the device.

The most notable deficiency in the Yasuga device, and the prime reason for its commercial failure, is its complex means for originally positioning the tile on the base of the tile cutter. Yasuga uses a graduated scale embossed on the base of the tile cutter and two bars on either side of the center line to engage the straight edges of the tile to hold it in position. Each of these two bars requires two screws to tighten it in position. Thus, to position a tile for a precise cut in the Yasuga device, four screws must be loosened, two bars moved, the tile must be positioned using the scale, the two bars must be repositioned to engage the edges of the tile and the four screws must be retightened. Both the device and the process are too complex and too time-consuming for the tile installer who is simply trying to move quickly to make a profit on the job. And despite the alleged precision attainable with the device of Yasuga, this device is not capable of positioning a tile for a precise diagonal cut.

The device of the present invention provides a simple means to make the usual straight cuts and also permits quick and precise diagonal cuts.

All tile cutters operate on the same basic principles. The tile is first scored and then pressure is applied on each side of the score to fracture the tile along the score. The ultimate design objective is to obtain as clean a break as possible, or a straight, flat edge along the fracture. A second design objective is to position the fracture as accurately as possible on the tile so that the resulting fractured tile fits precisely into the desired pattern of the finished work. A third design objective is to accomplish the two prior objectives as quickly as possible to save labor. A fourth design objective is to minimize the pressure required to fracture the tile to prevent marring of the tile surface. All of these design objectives are achieved by the improved simple structure of the tile cutter of the present invention.

The present invention uses a simple L-shaped bar held in position by only one screw to position a tile for an accurate cut. A notch in one leg of the L-shaped bar and an angle on the other leg permit diagonal cuts to be made with equal precision. While this might be suggested by the prior art, it is not disclosed therein and represents a significant improvement over the prior art including the recent Yasuga patent.

SUMMARY OF THE INVENTION

The present invention pertains to a unified tile scoring and fracturing device, commonly known as a tile cutter, which incorporates precise positioning of the tile to be cut, a simple scoring device and a simple but effective means of effecting a clean fracture along the score line. The tile cutter has a base of substantially rectangular shape, said base having an upper work surface which is almost entirely covered by two symmetrical rectangular resilient pads, disposed on either side of its longitudinal center line. A narrow space known as the scoring channel separates the resilient pads. Located near the forward end of the support base member is the adjustable guage bar means which holds the work piece in a present scoring position and which will be discussed hereinafter. At each of the opposite ends of the support base member is a vertically oriented guide rod support member positioned along the longitudinal center line of the base member, said vertical support members serving to position and support the ends of a guide rod. The guide rod is a horizontally-oriented, rectangularly shaped plate which extends substantially the length of the base member. The guide rod is above and parallel to the longitudinal center line of the base member and serves to guide and support the scoring and fracturing member of the tile cutter. The scoring and fracturing member is a generally L-shaped member whose longer, horizontal leg serves as its handle and whose shorter, vertical leg supports a cutting or scoring desk and lateral fins which serve as the fracturing means. The scoring and fracturing means is slidably received along the guide rod through an opening near the top of its vertical leg.

The scoring fracturing member has three principal regions each of which contribute to its operation. Its elongated horizontal leg serves as a handle for pushing it along the guide rod and for exerting leveraged pressure when required.

The vertical leg of the scoring and fracturing means has an upper region which incorporates an opening or guide channel to permit it to slide along the guide rod. Additionally this guide channel has a downward sloping base such that it is narrower at its forward edge than at its trailing edge. This permits the scoring and fracturing means to be pivoted upwardly to accomodate thicker tiles and downwardly to permit the fracturing of scored tiles.

The vertical leg of the scoring and fracturing means has a lower region which supports at its forward end a fixed rotatable scoring disk or cutting wheel, the operative edge of which must be positioned below the base of the vertical leg of the scoring and fracturing means.

The vertical leg of the scoring and fracturing means also supports a pair of laterally extending fins positioned as far to the rear of the vertical leg as possible and well behind the cutting edge. These lateral fins are essentially triangular in shape and symmetrically opposed to one another. They have base edges which slope slightly upward such that downward pressure for fracturing a scored tile is concentrated at their extreme tips. These extreme tips should be positioned as far as possible from the center line of the base member to insure a clean fracture.

The adjustable guage bar means of the present device presents one of its points of novelty and contributes greatly to its simplicity of use. The adjustable guage bar is basically an L-shaped rod member having an elongated transverse member slidably received into a transverse channel across the forward edge of the base support member. Its other shorter leg is perpendicularly secured to the longer leg. This adjustable L-shaped member permits two edges of a square or rectangular tile to be precisely positioned on the base of the tile cutter with one simple screw adjustment. The transverse leg of the adjustable L-shaped member also has a small notch positioned about midway along its length. The shorter, longitudinal leg has a trailing edge which angles inwardly. For an angular cut in a rectangular or square tile, the corner of the tile is placed in the notch on the transverse leg of the guage bar, the side edge of the tile is positioned along the angular trailing edge of the longitudinal leg and the guage bar and the gauge bar is tightened into position. A precise diagonal cut can now be made at any position in the tile. With appropriate adjustments any straight angular cut can be made with the precision necessary for fine workmanship in the finished installation.

The present invention provides a very basic and simple device for scoring and fracturing all commercially available tiles, something which no other tile cutter can do. It provides the simplest and easiest guage bar of all tile cutters, adjusting to any measurement with extreme precision, even for diagonal cuts. It has only one position for the scoring or cutting wheel. Nothing else is necessary. The handle-holding scoring wheel is adjusted for a solid grip and the end of the handle provides a flat pressure area for breaking or fracturing tile. The pressure or breaking points of the lateral fins are approximately four inches apart, further apart than in any other device, to provide additional leverage in breaking or fracturing of a tile. The tile cutter of this invention will easily score and fracture ceramic tile from ordinary four and ¼ inch wall tile to sizes up to ten inches square and ¾ inches thick. The scoring or cutting wheel used on this device is a plain carbide wheel having no special bushings as required by most other cutting wheels.

BRIEF DESCRIPTIONS OF THE DRAWINGS

FIG. 1 is a side elevational view of the preferred embodiment of the tile cutter of this invention showing the scoring-fracturing means in a forward position.

FIG. 2 is a top plan view of the tile cutter of FIG. 1 with a work piece shown in outline on the supporting base member.

FIG. 3 is a cross sectional view taken along the line 3—3 of FIG. 1.

DESCRIPTION OF THE PREFERRED EMBODIMENT

Referring now to FIG. 1, which is a side elevational view of the preferred embodiment of the tile cutter of the present invention designated generally by the reference numeral 10. FIG. 1 shows the scoring-fracturing means in its forward position, just after a tile has been scored and prior to its being fractured. Tile cutter 10 has a lower supporting base member 12 which is a substantially rectangularly shaped support block having a relatively flat upper surface 13. Upper surface 13 is almost entirely covered by two symmetrical, rectangular resilient pads 20, each of which is positioned on either side of the central longitudinal axis of upper surface 13 and each of which inclines slightly to its respective side edge of support base 12. Resilient pads 20 are separated by centrally oriented narrow scoring blade channel 18 which is a slight groove that extends substantially the entire length of support base member 12 along its longitudinal axis.

Vertical guide plate support members 14, 16 are secured to each end of support base member 12. Each guide plate support member 14, 16 has a vertical groove **23, 23*a* which serves to correctly align and immovably mount a guide rod 22 over and parallel to the longitudinal axis of base support member 12. Guide rod 22 is a horizontally oriented, rectangular shaped metal bar which extends between its support members 14, 16 and is displaced above the base member 12. Guide rod 22 serves to support and align the horizontal movement of the scoring-fracturing means 24**, which will be described more fully hereinafter.

Scoring-fracturing means 24 is a generally L-shaped structure which has three distinctly identifiable regions. Its upper most and longer leg is a horizontally oriented rectangularly shaped structure which serves as the control handle member 26 of the scoring fracturing member 24. Control handle 26 serves as the point of hand contact for the tile cutter during the dual processes of both scoring and fracturing the tile workpiece. Control handle 26 also serves to guide the scoring-fracturing means 24 during its forward and rearward movement along guide rod 22, which is a horizontal movement coplanar to and across the surface of the workpiece.

The vertical leg of the scoring-fracturing means 24 is a downward and forward sloping continuation of the horizontal leg having a convex shaped leading edge and a concave shaped trailing edge. The upper region of the vertical leg of scoring-fracturing means 24 is a centrally located hollow guide rod channel 28 which is sized such that guide rod 22 is slidably and snugly received therethrough providing a precise travel of scoring-fracturing means 24 along guide rod 22. Guide plate channel 28 has parallel side walls and an upper channel surface that is parallel to supporting base member 12. The lower interior surface of guide plate channel slopes downwardly from its leading edge to its trailing edge, as shown in phantom line 29 in FIG. 1. Guide plate channel 28 serves to precisely direct the horizontal scoring movement of scoring-fracturing means 24 along guide rod 22 with a minimum of lateral deviation during this horizontal movement. The downwardly sloping surface 29 of guide channel 28 permits a vertical pivotal movement of scoring-fracturing means 24 in upward and downward arcuate directions. The upward arcuate movement, having its pivot point designated 33, permits an upward adjustment of the scoring-fracturing means to accomodate very thick tile work pieces. The downward arcuate movement, having its pivot point designated 35, serves as a fulcrum for leverage in fracturing the workpiece.

The lower base region of the vertical leg of scoring-fracturing means 24 terminates in a substantially rectangular section designated 36. The forward end of section 36 serves as the attachment point for the small, circular rotatable scoring blade, disk or cutter 30 which serves as the means to score the tile workpiece. Disk 30, known in the trade as a cutting blade is a plain carbide which has no bushings as required by most other cutting wheels. It is so positioned that its operative edge is below the base of section 36.

A pair of symmetrical, laterally extending fracturing fins 34 are secured to the base region 36 of the vertical leg of scoring-fracturing means 24. These fins 34 are substantially triangular in shape and are positioned at the rearward end of section 36, and have slightly upward and inward inclining base edges, as illustrated in FIG. 3. The exterior tips 37 of fins 34 should be positioned as far as possible from the longitudinal axis of support base member 12. Tips 37 serve as the pressure points to fracture the scored tile workpiece when downward pressure is exerted on handle 26. The lever arm extends from pivot point or fulcrum 35 to tip 37 and should be as long as possible to minimize the pressure to fracture the tile workpiece.

Referring now to FIG. 2, an adjustable tile guage bar 38 is positioned along the forward end of base support member 12. Guage bar 38 is generally L-shaped and its longer leg 41 is positioned transverse to the longitudinal axis of support base member 12. Its shorter leg 42 is fixably secured to its longer leg 41. The transverse leg 41 of guage bar 38 may slide across base member 12 in a groove (not shown) and is secured in a desired position by a set screw, not shown. In the usual situation, the tile workpiece is rectangular in shape and can be easily held in position by adjustable guage bar 38. Angular tiles or diagonal cuts can also be made using adjustable guage bar 38. Guage bar 38 has a notch 45 located along its longer leg 41, and shorter leg 42 has an angular trailing edge 39. To make a diagonal cut in the typical square tile, one corner is positioned in notch 45, a side edge is placed against angular edge 39, and guage bar is tightened into position so that the line of cut is under disk or scoring blade 30. The tile is then scored and fractured in a conventional manner. These features of guide bar 38 may also be utilized to make cuts in tiles of other shapes such as hexogonal or octagonal tiles. As the shapes of popular tiles change, it may be advisable to utilize a plurality of guage bars 38 having varying angular tips 39. In any event, precise angular cuts can be made by using the adjustable guage bar 38 means of this invention. It should be noted that adjustable guage bar means can be secured in a fixed, precise position by tightening only one screw.

A recess 32 is provided at the forward end of base support member 12 to protect scoring blade 30 when tile cutter is not in use and during the fracturing operation.

In operation the cutting of the tile workpiece situated on the support base member 12 is accomplished by manually sliding horizontally the scoring-fracturing means 24 rearward, placing and securing a workpiece in the adjustable guide bar means 38, raising the scoring-fracturing means 24 slightly and sliding the scoring-fracturing means 24 forward along the guide plate 22, with simultaneous downward pressure on the control handle 26. This results in a precise scoring of the workpiece resting on the support base member 12, with the rotatable blade 30 dropping into the scoring blade recess 32.

Following the scoring operation described above, the fracturing operation is carried out as follows. With the scoring-fracturing means 24 in its extreme forward position along the guide plate 22, and the scoring blade 30 resting in the scoring blade recess 32, the control handle 26 is pressed further downward, thereby causing the tips 31 of the two fracturing arms 34, to exert a uniform downward pressure on the areas on the workpiece on the opposite sides of the scored line. This results in the even fracture of the workpiece along the previously scored line.

Thus the device of the present invention provides a very simple ceramic tile cutter which is simple to use and virtually free from malfunction. It also provides a simple adjustable guage bar means to permit angular cuts on tiles of various shapes.

I claim:

1. An improved tile cutter for scoring and fracturing ceramic tiles and the like, comprising:

a rectangular base member;

two resilient symmetrical, rectangular work surface pads positioned on the upper surface of said base;

a scoring blade channel along the longitudinal axis of said base member, separating said resilient work surface pads;

a recessed depression at the forward end of said scoring channel;

a pair of vertical support members positioned extending upwards from said base member;

an elongated rectangular guide rod secured at each end in grooves in said vertical support members, said guide rod positioned above and parallel to said scoring blade channel;

a tile scoring and fracturing means slidably mounted on said guide rod, comprising:

an L-shaped member having a horizontally oriented elongated handle portion, a downward sloping arcuate portion and a downward vertically oriented base portion;

said downward sloping arcuate portion having a guide channel with a downward and rearward sloping base to receive said guide rod and to permit said scoring and fracturing means to slide along said guide rod and to pivot arcuately;

a circular scoring blade rotatable secured to the forward most and lowest point of the base portion of said scoring and fracturing means;

two symmetrical, generally triangular fracturing arm fins, each extending outwardly and downwardly from opposed lower rear side surfaces of said scoring and fracturing means base portion; said fins having widely separated pressure points on their extreme ends;

a transversely adjustable L-shaped guage bar means having a notch therein positioned across and overhanging said base at its forward end to position a tile on said base, said guage bar having an angular trailing edge on its shorter leg.

* * * * *